US005842664A

United States Patent [19]

Åkerlund

[11] Patent Number: 5,842,664

[45] Date of Patent: Dec. 1, 1998

[54] METHOD AND DEVICE FOR THREADING A PAPER WEB OR AN EQUIVALENT WEB-LIKE MATERIAL IN A WINDING DEVICE, IN PARTICULAR IN A SLITTER-WINDER

[75] Inventor: Kenneth Åkerlund, Helsinki, Finland

[73] Assignee: Valmet Corporation, Helsinki, Finland

[21] Appl. No.: 892,596

[22] Filed: Jul. 15, 1997

[30] Foreign Application Priority Data

Jul. 16, 1996 [FI] Finland ..... 962868

[51] Int. Cl.[6] ..... B65H 16/00; B65H 19/20

[52] U.S. Cl. ..... 242/526.3; 242/532.7; 242/562.1; 226/92

[58] Field of Search ..... 242/526.3, 532.7, 242/562.1; 226/91, 92

[56] References Cited

U.S. PATENT DOCUMENTS

| | | | |
|---|---|---|---|
| 3,756,527 | 9/1973 | Collins et al. | 242/526.3 |
| 3,869,095 | 3/1975 | Diltz | 242/526.3 |
| 4,444,362 | 4/1984 | Karr | 242/526.3 |
| 4,458,852 | 7/1984 | Calvert et al. | 242/526.3 |
| 4,637,566 | 1/1987 | Kyytsönen | 242/532.7 |
| 4,695,004 | 9/1987 | Grossmann et al. | 242/526.3 |
| 5,094,394 | 3/1992 | Saukkonen | 242/562.1 |
| 5,152,471 | 10/1992 | Goerner | 242/532.7 |
| 5,316,229 | 5/1994 | Draghetti | 242/562.1 |
| 5,360,179 | 11/1994 | Vesterinen et al. | 242/526.3 |
| 5,531,396 | 7/1996 | Kinnunen et al. | 242/526.3 |

*Primary Examiner*—John M. Jillions
*Attorney, Agent, or Firm*—Steinberg & Raskin, P.C.

[57] ABSTRACT

A method and device for threading a paper web or an equivalent web-like material in a winding device, in particular in a slitter-winder, in which the paper web or the equivalent web-like material is wound from a web reel or equivalent onto another roll. A threading wedge is formed into the paper web or equivalent web-like material and passed through the winding device. Substantially at the same time as the web reel is unwound, a threading wedge narrower than the width of the web is separated from the web by a wedge-making device/devices and the web is passed by threading devices through the winding device. The arrangement includes members for winding the paper web or equivalent web-like material from the web reel or equivalent onto another roll, a pulling device or equivalent for unwinding the web from the web reel, a wedge-making device/devices for cutting the threading wedge substantially at the same time from the web and threading devices for passing the threading wedge through the winding device substantially at the same time.

18 Claims, 3 Drawing Sheets

METHOD AND DEVICE FOR THREADING A PAPER WEB OR AN EQUIVALENT WEB-LIKE MATERIAL IN A WINDING DEVICE, IN PARTICULAR IN A SLITTER-WINDER

FIELD OF THE INVENTION

The present invention relates to a method for threading a paper web or an equivalent web-like material in a winding device, in particular in a slitter-winder, in which the paper web or the equivalent web-like material is wound from a web reel or equivalent onto another roll and a threading wedge is formed into the paper web or equivalent web-like material and passed through the winding device.

Further, the present invention relates to a device for threading a paper web or an equivalent web-like material in a winding device, in particular in a slitter-winder, which comprises members for winding the paper web or the equivalent web-like material from the web reel or equivalent onto another roll.

BACKGROUND OF THE INVENTION

As known in the prior art, the threading of a leader end of a paper web or an equivalent web-like material in a winding device, for example in a slitter-winder, is usually started by shaping the end of the web into a wedge shape on the reel face manually, for example by tearing or cutting. The end of the wedge is guided manually to the threading devices, which carry the web end through the winding device. It is one of the drawbacks of this typical prior art threading method that the threading process usually requires at least two operators, one of whom prepares the threading wedge of the web and guides the web to the threading devices, and the other controlling the winding device. In practice, the threading is almost always carried out by three operators, two of whom prepare the threading wedge and the third controlling the winding device. Thus, the threading process takes an abundance of working time and results in associated labor expenses. Threading is also slow because the preparation of the wedge on the reel face takes time, which reduces the capacity of the winding device because during this time, the winding device cannot be used for production running proper.

A threading wedge that has been made manually often has a low strength and can cause problems during the threading. A further problem is involved in locating the hand-made threading wedge in the correct location and at the correct width.

With respect to the prior art, reference is made, e.g., to Finnish U.S. Pat. No. 69,439 (corresponding to U.S. Pat. No. 4,637,566 incorporated herein by reference in its entirety) which describes an arrangement in which the end of the web is passed from the machine reel or equivalent through the winding device along a path determined by the members that guide the web. The web end is passed from the machine reel through the winding device while having a full width so that the end of the web placed on the machine reel is grasped and the web is wound the desired number of windings around the pick-up and grasping device that is used. Thereafter, the web is passed as two-fold through the winding device so that the web is unwound at the same time both from the machine reel and from the pick-up and grasping device that is used. In this prior art construction, the arrangement that is used for threading the two-fold web end of full width is quite complicated and expensive to carry out.

OBJECTS AND SUMMARY OF THE INVENTION

It is an object of the present invention to provide a solution for the problems described above.

Another object of the invention is to provide a procedure in which no additional operator capacity is required during threading at the winding device.

It is a further object of the invention to provide automatic preparation of the threading wedge, in which case, the locating of the threading wedge is correct also in respect of the width and in respect of the wedge formation point in relation to the threading devices.

It is another object of the present invention to provide a new and improved method and device for threading a paper web or an equivalent web-like material in a winding device, such as a slitter-winder.

In view of achieving the objects stated above and others, in the method in accordance with the invention, substantially at the same time, the web reel is unwound, a threading wedge narrower than the width of the web is separated from the web by means of a wedge-making device/devices, and the web is passed by means of threading devices through the winding device.

The device in accordance with the invention comprises a pulling device or equivalent for unwinding the web from the web reel, a wedge-making device/devices for cutting the threading wedge from the web substantially at the same time as the web is being unwound from the web reel, and threading devices for passing the threading wedge through the winding device substantially at the same time as the threading wedge is being cut and the web is being unwound from the web reel.

According to the invention, the end of the paper web is pulled from the machine reel substantially while it has a full width by means of a pulling device, and, at the same time, a strip narrower than the web width, i.e., a threading wedge, is cut out of the web. Further, at the same time with the making of the wedge, the end of the web is passed through the winding device, for example a slitter-winder. The threading wedge is separated so that, when it is cut, it can be guided away from the web plane, i.e., the plane in which the remaining portion of the web is running. The threading wedge is guided through the winding device during its cutting, and after the threading wedge has proceeded some distance, its width is increased by displacing the cutting device/devices toward the edge(s) of the web so that the wedge has finally reached the width of the web.

In accordance with the present invention, a quicker threading is achieved, compared with prior art constructions because the threading wedge can already be guided through the winding device, such as a slitter-winder, while it is being cut. Further, by means of the arrangement based on the threading method in accordance with the present invention, the threading can be carried out so that at the machine, only one operator is needed, who controls both the threading devices and the winding device at the same time.

Further, the threading wedge that is produced in the system in accordance with the invention is cut mechanically, in which case, it has a high strength and thus does not cause problems in the threading as easily as in typical prior art constructions in which the wedge has been torn manually, in which case it can be torn off readily. Further, when a wedge is made automatically by means of a cutting device, locating the wedge at the correct location in relation to the threading devices and making the proper width of the wedge can be accomplished simply and readily, in which case the threading equipment operates adequately.

The threading of the web in accordance with the invention is favorably suitable for use in connection with unwind stands, for example with a slitter-winder, in particular with a drum winder or a carrier-belt slitter-winder, but it is also suitable for use in connection with slitter-winders and winders of other types.

One exemplifying embodiment of the method for threading a web into a winding device in accordance with the invention comprises the steps of unwinding the web from the reel, cutting and separating a threading wedge having a width narrower than the width of the web on the reel from the web at substantially at the same time as the web is unwound from the reel, and passing the threading wedge through the winding device at substantially at the same time as the web is unwound from the reel and the threading wedge is cut and separated from the web. The threading wedge may be guided away from a plane in which a remaining part of the web is running to at least one threading device, and its width increased until it reaches the width of the web. In one embodiment, the threading wedge is guided through slitting blades in the winding device, directed from the slitting blades into connection with a first carrier drum to be carried on a face thereof, separated from the first carrier drum when the threading wedge reaches the full width of the web, and thereafter directed while having the full width of the web over a second carrier drum situated in advance of the first carrier drum. The web may be cut after the threading wedge having the full width of the web has passed through the winding device and been threaded therein, and thereafter a new roll spool is inserted into a winding position onto which the threaded web is wound.

In one general exemplifying embodiment of the device in accordance with the invention for threading a web from a web reel into a winding device, the device comprises pulling means for unwinding the web from the web reel, cutting means for cutting the web to form a threading wedge substantially at the same time as the pulling means unwind the web from the web reel, and passing means for passing the threading wedge through the winding device substantially at the same time as the pulling means unwind the web from the web reel and the cutting means cut the web to form the threading wedge. The pulling means may comprise a suction roll movable into engagement with the web reel such that the web reel attaches thereto, the suction roll being rotated to unwind the web from the web reel, or means for pulling the web into a pulper. The passing means may comprise guide plates for directing the passage of the web through the winding device and/or a grasping device for grasping an edge of the web and drawing the web over the entire distance of the winding device. In the latter case, the cutting means may comprise a wedge making device including a single cutting blade arranged to cut from a first edge of the web while the grasping device grasps this first edge of the web. The single cutting blade is movable across the width of the web to increase the width of the threading wedge.

The cutting means may comprise a wedge making device comprising first and second cutting blades for cutting longitudinal lines into the web, the threading wedge being formed between these longitudinal lines, and a third cutting blade for cutting the web in a cross-direction between these longitudinal lines at an initial stage of cutting to thereby form a front edge of the threading wedge.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
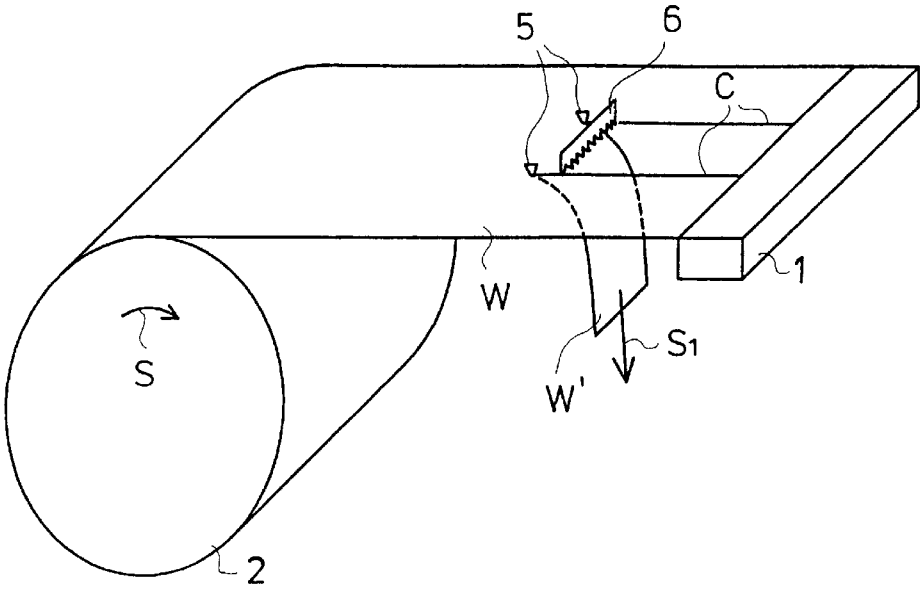
FIG. 1 is a schematic illustration of an exemplifying embodiment of the invention.

Referring to FIGS. 1–6 wherein like reference numerals refer to the same or similar elements, as shown in FIG. 1, an end of the paper web W is pulled from a machine reel 2 which revolves in the direction indicated by arrow S as of full width, i.e., while it has the same width as when it is reeled, by means of a pulling device 1, and at the same time, a strip W' narrower than the web width, i.e., a threading wedge, is cut out of the web W by means of blades 5 of a wedge making device. The strip W' is separated so that, when it is cut, it can be guided away from the plane of the web W in the direction indicated by arrow $S_1$. The wedge W' is guided through the winding device while the wedge is being cut, and after the wedge W' has proceeded a certain distance, its width is increased by displacing the cutting blades 5 toward the edges of the web W until the wedge W' finally reaches the width of the web W. By means of a cross-cut blade 6, the web W is cut off between the cut lines C in the initial stage of the formation of the threading wedge.

Figure 2:
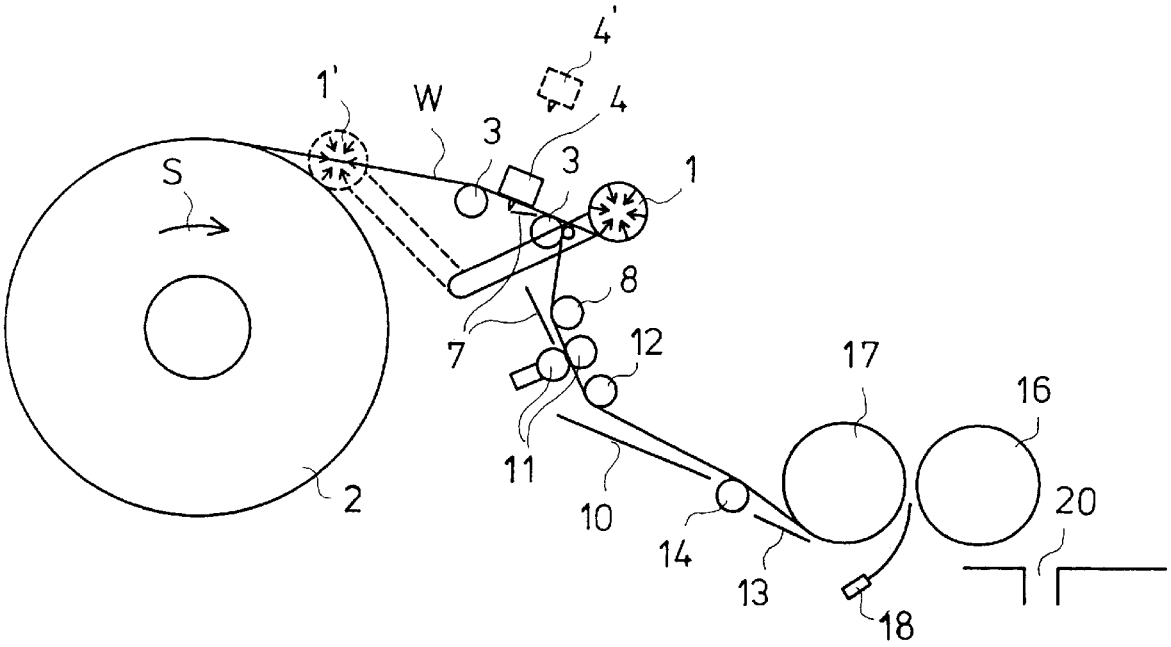
FIG. 2 is a schematic illustration of another exemplifying embodiment of the invention.

In the embodiment shown in FIG. 2, the end of the web W is picked up by means of a movable suction roll 1 as of full width from the face of the machine reel 2 revolving in the direction indicated by arrow S. The suction roll 1 is directed from the position indicated by the dashed line (designated 1') to the station for cutting of the threading wedge W', and a wedge making device 4 is directed from the position indicated by the dashed lines (designated 4') toward the web W while the suction roll 1 revolves constantly to pull the web from the reel 2 and thus impart forward movement to the threading wedge. The web W runs while guided by guide rolls 3. The wedge making device 4 comprises the two blades 5, which cut two longitudinal cuts C (FIG. 1) into the web W, and the separate cross-direction blade 6, which cuts off the web W between the cut lines C (FIG. 1) and enables the threading wedge W' to be guided away from the plane of the web W. While the suction roll 1 revolves constantly, the threading wedge W' is guided by means of guide plates 7 onto a first line of rolls 8 in the slitter-blade board, after which the threading wedge W' is guided through slitter blades 11 of the slitter-winder. After a second row of blades 12 in the slitter-blade board, the threading wedge W' is passed, while being guided by a guide plate 10, onto spreader rolls 14. The end of the wedge W' is passed by means of a guide plate 13 over the spreader rolls 14 onto carrier drums 16,17. The wedge W' is carried on the face of the rear carrier drum 17 while the drum revolves, by means of the suction present in the carrier drum 17. From the face of the rear carrier drum 17, the wedge W' is separated by means of blowing(s) 18, which, at the same time, guides the wedge over the forward carrier drum 16. The end of the wedge W' is guided from the forward carrier drum 16 through a gap 20 directly into the pulper. The wedge W' is run directly into the pulper until the wedge has come through as of full width. The wedge W is cut off, new spools are inserted, and the winding is started.

Figure 3:
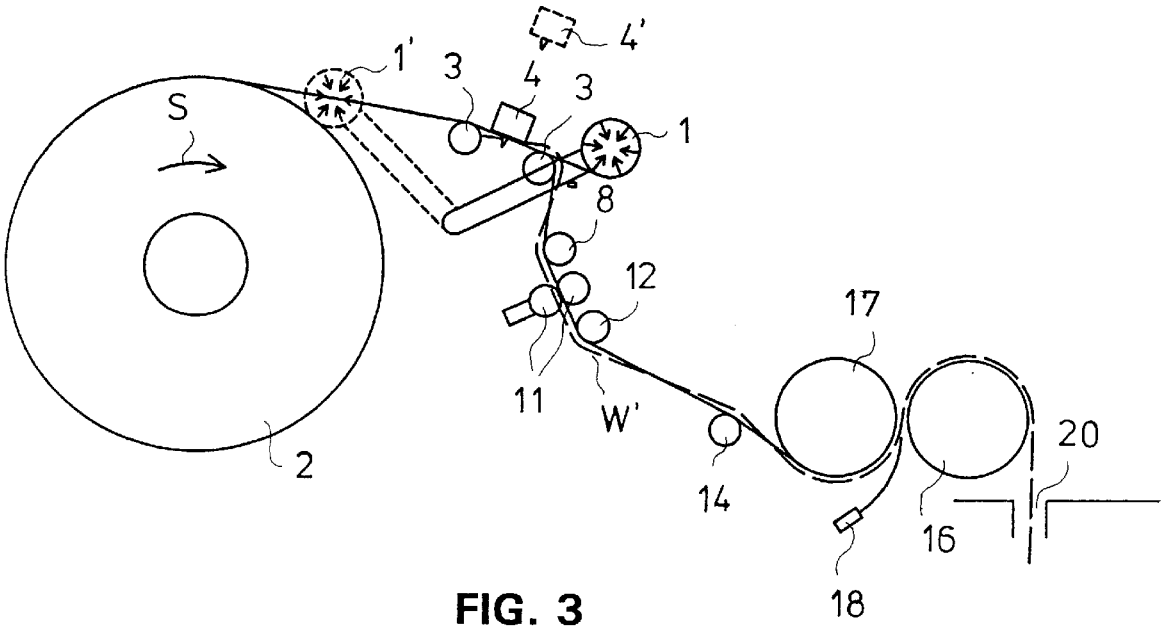
FIG. 3 is a schematic illustration of another exemplifying embodiment of the invention.
Figure 4:
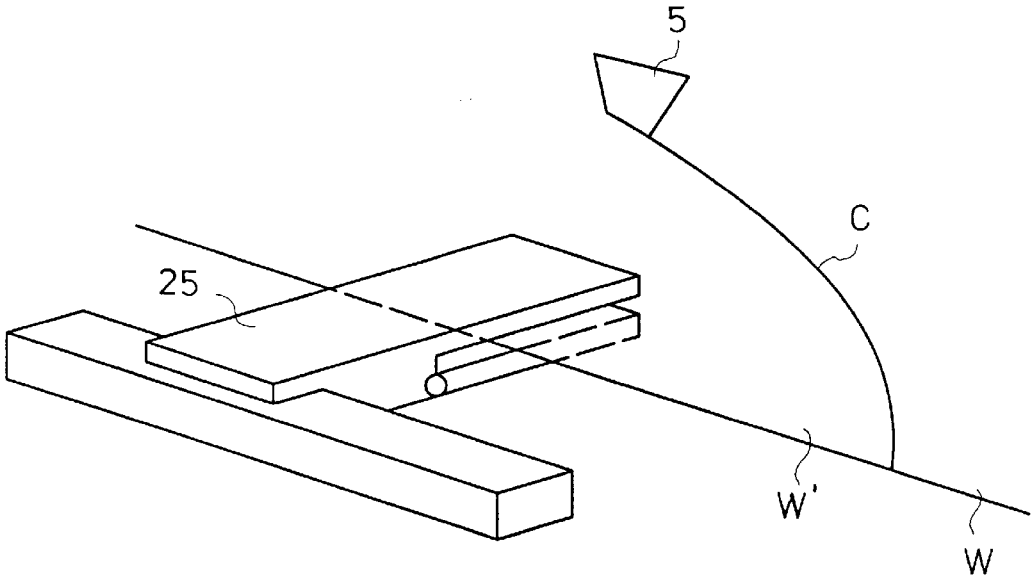
FIG. 4 is a schematic illustration of a grasping device used in the exemplifying embodiment illustrated in FIG. 3.

In the exemplifying embodiment shown in FIGS. 3 and 4, the end of the web W is picked up as of full width by means of the displaceable suction roll 1 from the face of the reel 2 which revolves in the direction indicated by the arrow S. The suction roll 1 is run from the position designated 1' indicated by the dashed line to the wedge cutting station, and the wedge making device 4 is run from the rest position thereof designated 4', indicated by the dashed lines, toward the web W while the suction roll 1 revolves constantly and while the guide rolls 3 support the web W. By means of a grasping device 25 (FIG. 4) which runs at the edge of the slitter-winder through the whole slitter-winder, the edge of the web W is grasped before the wedge making device 4. In the wedge making device 4, there is one cutter blade 5 which is adapted to move from one edge of the web to the other. The web W is cut before the grasping device 25, in which connection a strip, i.e., the threading wedge W', is separated at the edge of the web W to include the same. The grasping device 25 passes the threading wedge W' through the slitter-winder at the same time as the suction roll 1 revolves. After the end of the wedge has proceeded a certain distance, the threading wedge W' is widened to the web W width by displacing the cutter blade 5 toward the opposite edge of the web. The grasping device 25 passes the end of the wedge through the slitter-winder, and the wedge W' is run onto the carrier drums 16 and 17 in compliance with the preceding exemplifying embodiment, and further through the gap 20 into the pulper until the web W has come through the whole slitter-winder as of full width. Thereafter, the web W is cut off and the spools are inserted, after which the winding is started.

Figure 5:
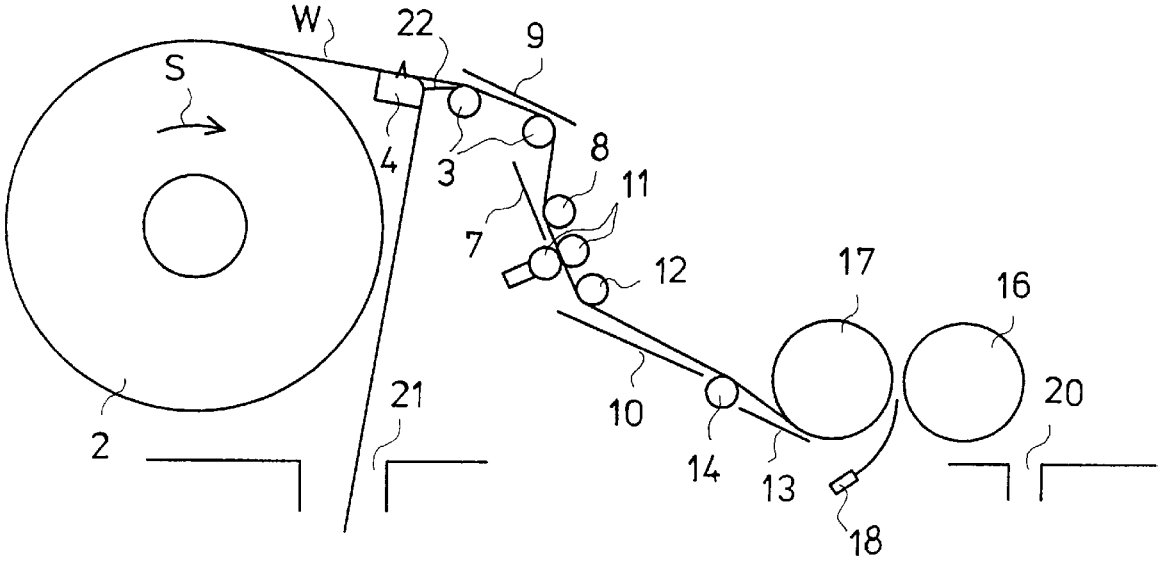
FIG. 5 is a schematic illustration of a further exemplifying embodiment of the invention.

In the exemplifying embodiment of the invention shown in FIG. 5, the web W is pulled from the machine reel 2, which revolves in the direction indicated by the arrow S, as of substantially full width into a pulper 21, which pulper operates, in this exemplifying embodiment of the invention, as the web pulling device. By means of the wedge making device 4, a threading wedge is formed into the web W, which wedge is guided over a guide plate 22 between the guide rolls 3 and a guide plate 9, guided by the guide plate 7, over the cutter-blade board 8,11,12, further supported by the guide plates 10, onto the spreader rolls 14, from which the web W is guided onto the carrier drums 16,17 by means of the guide plate 13 and, similarly, by means of the blowing 18, as in the preceding exemplifying embodiments, the web W is cut off, and new winding is started.

Figure 6:
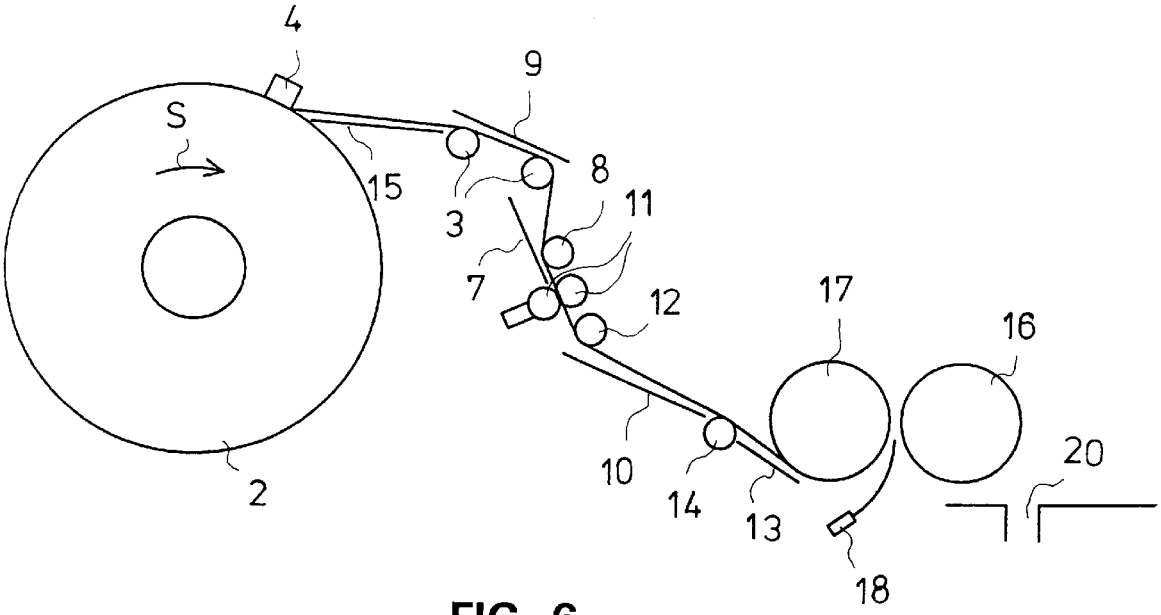
FIG. 6 is a schematic illustration of a further embodiment of the invention.

In the exemplifying embodiment shown in FIG. 6, the threading wedge is cut by means of the wedge making device 4 on the face of the machine reel 2 revolving in the direction indicated by the arrow S, and the tip of the wedge is picked up from the face of the machine reel 2 revolving in the direction indicated by the arrow S and guided onto the guide plate 15 and from there further to between the guide rolls 3 and the guide plate 9. In this exemplifying embodiment of the invention, the web W is pulled by the tip of the threading wedge, and in this exemplifying embodiment of the invention the machine reel 2 operates as the device that pushes the web W of full width. As is the case in the other exemplifying embodiments described above, simultaneously with the formation of the wedge the web W is guided through the slitter-winder.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims. For example, the method and arrangement in accordance with the invention are also suitable for other types of slitter-winders besides those described in the preceding exemplifying embodiments and also for winding devices of other types besides those described above.

I claim:

1. A method for threading a web into a winding device, comprising the steps of:

unwinding the web from a reel, the step of unwinding the web comprising the steps of displacing a suction roll into engagement with a face of the reel to attach to an end of the web, displacing the suction roll away from the reel to a cutting position after the end of the web is attached thereto and rotating the suction roll in the cutting position, cutting and separating a threading wedge having a width narrower than the width of the web on the reel from the web while unwinding the web from the reel and the suction roll is in the cutting position, the step of cutting and separating the threading wedge comprising the step of displacing a wedge making device toward the web, and passing the threading wedge through the winding device at substantially the same time as the threading wedge is cut and separated from the web.

2. The method of claim 1, further comprising the steps of:

guiding the threading wedge away from a plane in which a remaining part of the web is running, and increasing the width of the threading wedge until the threading wedge reaches the width of the web.

3. The method of claim 2, wherein the width of the threading wedge is increased by displacing the wedge making device.

4. The method of claim 1, wherein said step of cutting and separating the threading wedge from the web comprises the steps of:

forming two longitudinal cut lines in the web by means of the wedge making device such that the threading wedge is defined between said two cut lines, and cutting the threading wedge in the cross direction between said two cut lines in the initial stage of the cutting.

5. The method of claim 1, further comprising the step of increasing the width of the threading wedge until it reaches the full width of the web after the threading wedge has proceeded a certain distance through the winding device.

6. The method of claim 1, further comprising the steps of: guiding the threading wedge away from a plane in which a remaining part of the web is running, and guiding the threading wedge through slitting blades in the winding device, directing the threading wedge from the slitting blades into connection with a first carrier drum to be carried on a face thereof, separating the threading wedge from the first carrier drum when the threading wedge reaches the full width of the web, and thereafter directing the threading wedge having the full width of the web over a second carrier drum situated in advance of said first carrier drum.

7. The method of claim 1, wherein said step of cutting and separating the threading wedge from the web comprises the steps of cutting the threading wedge from a first edge of the web to include the first edge of the web, and widening the threading wedge to a second edge of the web opposite to the first edge of the web after the threading wedge has proceeded a certain distance through the winding device, further comprising the step of:

grasping the first edge of the web by means of a grasping device extending substantially over the entire length of the winding device.

8. The method of claim 1, further comprising the steps of:

increasing the width of the threading wedge until the threading wedge reaches the full width of the web, cutting the web after the threading wedge having the full width of the web has passed through the winding device and been threaded therein, and thereafter inserting a new roll spool onto which the threaded web is wound.

9. A device for threading a web from a web reel into a winding device, comprising pulling means for unwinding the web from the web reel, said pulling means comprising a suction roll movable into engagement with the web reel such that the web reel attaches to said suction roll, said suction roll being rotatable to unwind the web from the web reel, cutting means for cutting the web to form a threading wedge substantially at the same time as said pulling means unwind the web from the web reel, and passing means for passing the threading wedge through the winding device substantially at the same time as said pulling means unwind the web from the web reel and said cutting means cut the web to form the threading wedge.

10. The device of claim 9, wherein said passing means comprise guide plates for directing the passage of the web through the winding device.

11. The device of claim 9, wherein said passing means comprise a grasping device for grasping an edge of the web and drawing the web over the entire distance of the winding device.

12. The device of claim 11, wherein said cutting means comprising a wedge making device including a single cutting blade, said single cutting blade being arranged to cut from a first edge of the web, said grasping device being arranged to grasp said first edge of the web, said single cutting blade being movable across the width of the web to increase the width of the threading wedge.

13. The device of claim 9, wherein said cutting means comprise a wedge making device comprising first and second cutting blades for cutting longitudinal lines into the web, the threading wedge being formed between said longitudinal lines, and further comprising a third cutting blade for cutting the web in a cross-direction between said longitudinal lines at an initial stage of cutting to thereby form a front edge of the threading wedge.

14. The device of claim 9, wherein said cutting means comprise a wedge making device movable relative to the web.

15. A method for threading a web into a winding device, comprising the steps of:

unwinding the web from a reel;

cutting and separating a threading wedge having a width narrower than the width of the web on the reel from the web while unwinding the web from the reel;

guiding the threading wedge away from a plane in which a remaining part of the web is running to the winding device at substantially the same time as the threading wedge is cut and separated from the web, the step of guiding the threading wedge to the winding device comprising the steps of guiding the threading wedge through slitting blades and directing the threading wedge from the slitting blades into connection with a first carrier drum to be carried on a face thereof;

separating the threading wedge from the first carrier drum when the threading wedge reaches the full width of the web; and thereafter directing the threading wedge having the full width of the web over a second carrier drum situated in advance of said first carrier drum.

16. A method for threading a web into a winding device, comprising the steps of:

unwinding the web from a reel, cutting and separating a threading wedge having a width narrower than the width of the web on the reel from the web while unwinding the web from the reel, the step of cutting and separating the threading wedge from the web comprising the steps of cutting the threading wedge from a first edge of the web to include the first edge of the web and widening the threading wedge to a second edge of the web opposite to the first edge of the web after the threading wedge has proceeded a certain distance through the winding device, passing the threading wedge through the winding device at substantially the same time as the threading wedge is cut and separated from the web, and grasping the first edge of the web by means of a grasping device extending substantially over the entire length of the winding device.

17. A method for threading a web into a winding device, comprising the steps of:

rotating a reel of the web, cutting a threading wedge having a width narrower than the width of the web on the face of the reel, separating the threading wedge from the web while unwinding the web from the reel by picking up an end of the threading wedge from the face of the web reel, passing the threading wedge through the winding device at substantially the same time as the threading wedge is cut and separated from the web, and increasing the width of the threading wedge to the full width of the web after the threading wedge has proceeded a certain distance through the winding device.

18. A device for threading a web from a web reel into a winding device, comprising pulling means for unwinding the web from the web reel, cutting means for cutting the web to form a threading wedge substantially at the same time as said pulling means unwind the web from the web reel, said cutting means being arranged to cut the web on a face of the web reel such that the web reel pushes the web at said cutting means, and passing means for passing the threading wedge through the winding device substantially at the same time as said pulling means unwind the web from the web reel and said cutting means cut the web to form the threading wedge.

* * * * *